United States Patent [19]

Ohtsuka et al.

[11] Patent Number: 4,956,256

[45] Date of Patent: Sep. 11, 1990

[54] PHOTOSENSITIVE MEMBER FOR ELECTROPHOTOGRAPHY

[75] Inventors: Shigenori Ohtsuka, Omiya; Hiroshi Urabe, Kawasaki; Masahiro Nukui; Mamoru Nozomi, both of Machida; Setsuko Sasakawa, Yokohama, all of Japan

[73] Assignee: Mitsubishi Chemical Industries Limited, Tokyo, Japan

[21] Appl. No.: 364,251

[22] Filed: Jun. 9, 1989

Related U.S. Application Data

[63] Continuation-in-part of Ser. No. 23,708, Mar. 9, 1987, abandoned.

[30] Foreign Application Priority Data

Mar. 14, 1986 [JP] Japan ..... 61-56684
Dec. 12, 1986 [JP] Japan ..... 61-296184

[51] Int. Cl.[5] ..... G03G 5/05
[52] U.S. Cl. ..... 430/96; 430/58
[58] Field of Search ..... 430/96, 58

[56] References Cited

U.S. PATENT DOCUMENTS 4,637,971 1/1987 Takei et al. ..... 430/96

*Primary Examiner*—J. David Welsh
*Attorney, Agent, or Firm*—David G. Conlin; Ronald I. Eisenstein

[57] ABSTRACT

A photosensitive member for electrophotography comprising a photosensitive layer on a conductive substrate, said photosensitive layer containing as a binder resin a modified polycarbonate resin having the repeating structural units represented by the following general formula (1) and (2);

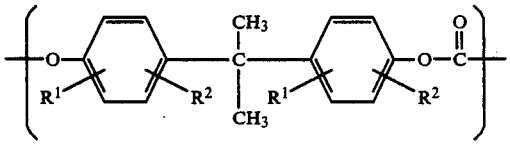

(1)

wherein $R^1$ and $R^2$ are selected from a hydrogen atom, an alkyl group having 1–3 carbon atoms and a halogen atom, at least one of $R^1$ and $R^2$ being the alkyl or the halogen atom, and

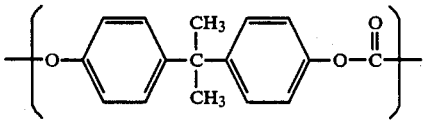

(2)

the ratio of the repeating structural unit of the general formula (1) to that of the general formula (2) being at least 20:80. This photosensitive member is highly resistant to mechanical wear and the deterioration of sensitivity and chargeability.

8 Claims, No Drawings

PHOTOSENSITIVE MEMBER FOR ELECTROPHOTOGRAPHY

This is a continuation-in-part of copending application Ser. No. 07/023,708 filed on 3/9/87, now abandoned.

BACKGROUND OF THE INVENTION

The present invention relates to a photosensitive member for electrophotography, and more particularly to a photosensitive member for electrophotography with excellent durability containing particular binder resins.

Since electrophotographic technology can provide instantaneous and high-quality images, it has been finding wider applications not only in copiers but also in various types of printers.

For photosensitive members which are the core of the electrophotographic technology, conventional inorganic photoconductive materials such as selenium, arsenic-selenium alloys, cadmium sulfide, zinc oxide, etc. are being used, and recently development has been made to provide photosensitive members made of organic photoconductive materials because of their advantages such as small weight, good film-forming properties and easiness to production.

Known as organic photosensitive members are double layer-type photosensitive members having a charge carrier-generating layer and a charge carrier transfer layer on a conductive substrate. Since this type is enjoying high sensitivity and durability, it is widely used.

However, despite the fact that the conventional organic, double layer-type photosensitive members have good electric properties such as sensitivity and chargeability, they are susceptible to mechanical wear and surface damage by such load as abrasion by a cleaning member. The surface wear and damage of a photosensitive member leads to deteriorated copy or print images. Therefore, they have only limited durability when actually used in copiers or printers.

Conventionally used for charge carrier transfer layers as binder resins are thermoplastic resins such as polycarbonate resins, acrylic resins, methacrylic resins, polyester resins, polystyrene resins, silicone resins, epoxy resins, polyvinyl chloride resins, etc., and various curable resins. Usually, the charge carrier transfer layer is made of a solid solution of the binder resin and a charge carrier transfer material, and the amount of this charge carrier transfer material doped is considerably large. Thus the charge carrier transfer layer does not have a sufficient surface strength. As a result, when it is used for a process employing a blade cleaning method, it provides images deteriorated by surface abrasion wear and damage after producing several thousands to about ten thousand of copies, making it inevitable to exchange the photosensitive member.

Among these binder resins, polycarbonate resins have relatively good mechanical properties, so that they enjoy relatively good durability. However, commercially available polycarbonate resins which are usually employed have poor solution stability because they are crystalline. Accordingly, although it provides a uniform solution in the initial stage, crystallization gradually takes place, resulting in the increase in gelation with time. When such solution is applied for preparing a photosensitive layer, a uniform layer is hard to obtain, resulting in low productivity of the photosensitive layer. In addition, the photosensitive members containing commercially available polycarbonate resins as binders are still unsatisfactory in terms of mechanical durability.

In addition to the above double layer-type photosensitive member, a proposal has recently been made to provide a so-called dispersion-type (single layer-type) photosensitive member having a binder resin-containing layer having a charge carrier transfer function, in which charge carrier-generating material particles are dispersed. Like the double layer-type photosensitive member, this dispersion-type photosensitive member suffers from surface damage and wear due to a mechanical load during the use. Accordingly, the binder resin used is required to have sufficient strength, and its solution for application should be stable. Particularly in this type, the dispersion stability of charge carrier-generating material particles is important. However, as in the above-mentioned double layer-type photosensitive member, commercially available polycarbonate resins have insufficient strength, and their solutions for forming photosensitive layers are poor in stability.

OBJECT AND SUMMARY OF THE INVENTION

An object of the present invention is, therefore, to provide a photosensitive member having a photosensitive layer with excellent durability.

Another object of the present invention is to provide a photosensitive member having a photosensitive layer which can be produced efficiently with extremely few defects.

As a result of intense research on binder resins capable of providing such photosensitive layers, the inventors have found that a particular modified polycarbonate resin has sufficient solution stability and good mechanical properties. The present invention has been made based on this finding.

Thus, the gist of the present invention consists in a photosensitive member for electrophotography having a photosensitive layer on a conductive substrate, the photosensitive layer containing as a binder resin a modified polycarbonate resin having the repeating structural unit represented by the general formula (1):

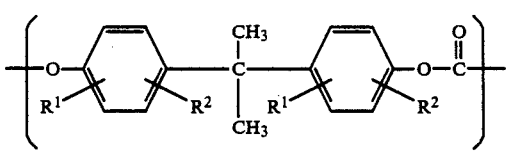

(1)

wherein $R^1$ and $R^2$ are selected from a hydrogen atom, an alkyl group having 1–3 carbon atoms and a halogen atom, at least one of $R^1$ and $R^2$ being the alkyl group or the halogen atom.

DETAILED DESCRIPTION OF THE INVENTION

The present invention will be explained in detail below.

The photosensitive member according to the present invention is formed on a conductive substrate. The conductive substrates which may be used include metal sheets made of aluminum, stainless steel, copper, nickel, etc., and insulating substrates of polyester films and papers coated with conductive layers of aluminum, copper, palladium, tin oxide, indium oxide, etc.

Formed on such conductive substrate is a double layer-type or dispersion-type photosensitive layer with a known barrier layer therebetween, if necessary. The barrier layer may be formed from metal oxides such as aluminum oxide and resins such as polyamides, polyurethane, cellulose and casein.

In the case of the double layer-type photosensitive member, the charge carrier-generating material and the binder resin are usually used in such a weight ratio that the binder resin is 0.1–10, preferably 0.2–3 per 1 of the charge carrier-generating material.

The charge carrier-generating layer usually has a thickness of 0.1–1 μm, preferably 0.15–0.6 μm.

The charge carrier transfer layer is constituted by the polycarbonate resin represented by the formula (1) and the charge carrier transfer material as main components, on the charge carrier-generating layer.

Usable as the charge carrier transfer materials in the charge carrier transfer layer are electron-attracting compounds such as 2,4,7-trinitrofluorenone and tetracyanoquinodimethane; and electron-donating materials such as heterocyclic compounds such as carbazole, indole, imidazole, oxazole, thiazole, oxadiazole, pyrazole, pyrazoline and thiadiazole, aniline derivatives, hydrazine derivatives, hydrazones, aryl amine derivatives and polymers having these compounds in their back bones or pendant groups.

Preferable among them are hydrazone compounds and aryl amine derivatives.

Preferred examples of the hydrazone compounds are compounds represented by the formulae (2) and (3).

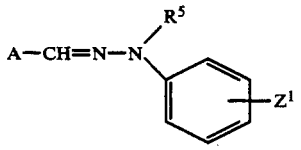

(2)

wherein A represents a monovalent residual group of a monocyclic or polycyclic aromatic hydrocarbon such as benzene, naphthalene, anthracene, pyrene, perylene, etc., or a monovalent residual group of an aromatic heterocyclic compound such as pyridine, quinoline, indole, carbazole, acridine, etc., which may have a substituent such as an alkyl group, an alkoxy group, an alkylamino group, a halogen atom, etc.; $R^5$ represents an alkyl group, an allyl group, a substituted alkyl group, an aryl group such as phenyl, naphthyl, etc. or an aralkyl group; and $Z^1$ represents a hydrogen atom, an alkyl group, an alkoxy group or a halogen atom.

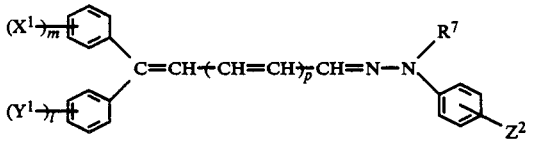

(3)

wherein $X^1$, $Y^1$ and $Z^2$ respectively represent a hydrogen atom, a lower alkyl group a lower alkoxy group, a phenoxy group or an arylalkoxy group; $R^7$ represents a hydrogen atom, a lower alkyl group, an allyl group, a phenyl group or an aralkyl group; m and l represent 1 or 2; and p represents 0 or 1. They may be used alone or in combination.

Preferable as aryl amine derivatives are compounds having in their molecules a skeleton moiety represented by the following formula (4):

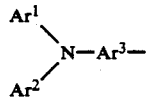

(4)

wherein $Ar^1$, $Ar^2$ and $Ar^3$ respectively represent aryl groups such as a phenyl group and a naphthyl group, or heterocyclic aromatic groups, which may have substituents such as an alkyl group, an alkoxy group, a halogen atom, etc.

These charge carrier transfer materials are mixed with the polycarbonate resin of the present invention to form a charge carrier transfer layer. The charge carrier transfer materials are usually 30–200 parts by weight, preferably 50–150 parts by weight per 100 parts by weight of the polycarbonate resin.

Further, the charge carrier transfer layer may contain known additives, such as plasticizers, additives for preventing the accumulation of residual potential, antioxidants, etc.

The charge carrier transfer layer, which has a thickness of 5–50 μm, and preferably 15–30 μm, is constructed on the charge carrier-generating layer.

In a case where the photosensitive layer is in a dispersion-type, the same charge carrier transfer materials as those used in the charge carrier transfer layer of the above double layer-type photosensitive member may be used. The same is true of the charge carrier-generating materials.

The modified polycarbonate resin according to the present invention contains the repeating structural unit represented by the above general formula (1). It may further contain the repeating structural unit represented by the following general formula (5).

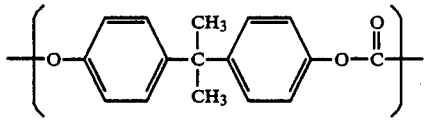

(5)

The ratio of the repeating structural unit (1) to the repeating structural unit (5) is at least 20:80, preferably at least 30:70. The modified polycarbonate resin usually has a viscosity-average molecular weight of about 10,000 to 50,000. Such modified polycarbonate resin may be advantageously used as a binder resin for the above photosensitive layer. In case where the photosensitive layer is a double layer-type, it may be used as a binder for either the charge carrier-generating layer or the charge carrier transfer layer, but it is preferably used as a binder for the charge carrier transfer layer.

The modified polycarbonate resin according to the present invention may be synthesized easily by a usual method, using one or more of phenolic compounds selected from the general formulae (6) and (7):

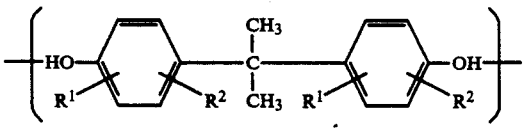

(6)

wherein $R^1$ and $R^2$ are the same as defined above, and at least one of $R^1$ and $R^2$ is an alkyl group or a halogen atom.

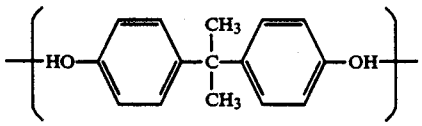

(7)

The ratio of the phenolic compound represented by the general formula (6) to the phenolic compound represented by the general formula (7) is at least 20:80, preferably at least 30:70, according to the above-described composition of the modified polycarbonate resin to be prepared.

Specific examples of the phenolic compound represented by the general formula (6) are bis (hydroxyphenyl)-propanes such as 2,2-bis (4-hydroxy-3-methylphenyl)-propane, 2,2-bis (4-hydroxy-3,5-dimethylphenyl)-propane, 2,2-bis (4-hydroxy-3-chloro-5-methylphenyl)-propane, 2,2-bis [4-hydroxy-3-(2-propyl)-phenyl]-propane.

The modified polycarbonate resin according to the present invention may be prepared specifically by adding an alkali aqueous solution or pyridine, etc. as an acid acceptor to the above phenolic compound in the presence of an inert solvent such as methylene chloride or 1,2-dichloroethane and introducing phosgene thereinto to cause a reaction therebetween.

In a case where an alkali aqueous solution is used as an acid acceptor, the use of tertiary amines such as trimethylamine and triethylamine or quaternary ammonium compounds such as tetrabutylammonium chloride and benzyltributylammonium bromide as a catalyst would increase the reaction rate.

Monovalent phenol such as phenol and p-t-butylphenol may be included as a molecular weight modifier. The catalyst may exist from the beginning, or it may be added after the formation of an oligomer to polymerize it.

The copolymerization of two or more phenolic compounds according to the present invention may be carried out by the following methods:

(a) Two or more phenolic compounds are reacted with phosgene simultaneously from the beginning to cause copolymerization thereof;

(b) One of them is first reacted with phosgene, and after the reaction has proceeded to some extent the other is introduced thereinto to cause polymerization reaction; or (c) They are separately reacted with phosgene to prepare oligomers which are in turn reacted with each other to provide the desired copolymer.

The modified polycarbonate resin thus prepared according to the present invention is highly soluble in organic solvents, showing high solubility in non-halogenous solvents such as ethyl acetate, 1,4-dioxane, tetrahydrofuran. Since coating solutions can be prepared therefrom by using these solvents, there would be no problem to safety and health.

The present invention will be explained in further detail by means of the following Reference Examples and Examples, but the present invention is not limited thereto. Incidentally, the term "part" used in the following Reference Examples and Examples means "part by weight."

| Reference Example 1 | |
|---|---|
| (a) Preparation of polycarbonate oligomer | |
| 2,2-bis (4-hydroxy-3-methylphenyl)-propane | 100 parts |
| Sodium hydroxide | 50 parts |
| Water | 870 parts |
| Methylene chloride | 530 parts |
| p-t-Butylphenol | 2.0 parts |

A mixture of the above components was introduced into a reactor with a stirrer, and stirred at 800 rpm. 70 parts of phosgene was blown thereinto over 2 hours to cause the interfacial polymerization. After completion of the reaction, only a solution of the resulting polycarbonate oligomer in methylene chloride was collected. The analysis of the collected solution of the oligomer in methylene chloride provided the following results:

| | |
|---|---|
| Concentration of oligomer(1) | 24.0 weight % |
| Concentration of chloroformate end group(2) | 0.56 N |
| Concentration of phenolic hydroxyl end group(3) | 0.13 N |

Note:
(1)Measured after evaporation to leave a solid component.
(2)Measured by neutralization titration of analine hydrochloride obtained by the reaction with aniline, with a 0.2-N sodium hydroxide aqueous solution.
(3)Measured by colorimetry at 546 nm after dissolved in a solution of titanium tetrachloride and acetic acid.

The oligomer solution obtained by the above method is called "oligomer solution-A" hereinafter.

| | |
|---|---|
| (b) Preparation of polycarbonate oligomer | |
| 16.6% bisphenol A sodium salt aqueous solution prepared by dissolving bisphenol A in a sodium hydroxide aqueous solution | 100 parts |
| p-t-Butylphenol | 0.23 parts |
| Methylene chloride | 40 parts |
| Phosgene | 7 parts |

A mixture of the above composition was quantitatively introduced into a pipe reactor to cause an interfacial polymerization. By separating the reaction mixture solution, only a solution of the resulting polycarbonate oligomer in methylene chloride was collected.

The oligomer solution in methylene chloride was analized. The results are as follows:

| | |
|---|---|
| Concentration of oligomer | 24.5 weight % |
| Concentration of chloroformate end group | 1.3 N |
| Concentration of phenolic hydroxyl end group | 0.3 N |

The oligomer solution obtained by the above method is called "oligomer solution-B" hereinafter.

| Reference Example 2 | |
|---|---|
| (a) Preparation of modified polycarbonate copolymer resin | |
| Oligomer solution-A | 80 parts |
| Oligomer solution-B | 180 parts |
| Methylene chloride | 100 parts |
| p-t-Butylphenol | 0.3 parts |

The above components were introduced into a reactor equipped with a stirrer, and subjected to stirring at 550 rpm. Further, an aqueous solution of the following composition was charged thereinto to carry out an interfacial polymerization for 3 hours:

| | |
|---|---|
| Sodium hydroxide | 14 parts |
| Triethylamine | 0.07 parts |
| Water | 80 parts |

The reaction mixture was separated to collect a solution of the resulting polycarbonate resin in methylene chloride, which was then washed with water, a hydrochloric acid solution and water in this order. Finally, methylene chloride was evaporated to isolate the resin. This resin (Resin No. C) had an average molecular weight of 15,500.

And the NMR analysis revealed that the amount of bisphenol A was 70.8 weight %.

Incidentally, the average molecular weight was obtained by calculation of the following equations (1) and (2) from $\eta_{sp}$ determined by measurement at 20° C. of a solution of 6.0 g/l of the polymer in methylene chloride.

$$\eta_{sp}/C = [\eta](1 + K'\eta_{sp}) \quad (1)$$

$$[\eta] = KM^{\alpha} \quad (2)$$

wherein $C$: Polymer concentration (g/l)

$[\eta]$: Intrinsic viscosity $K' = 0.28$ $K = 1.23 \times 10^{-5}$

-continued $\alpha = 0.83$ $M$: Average molecular weight

| (b) Preparation of modified polycarbonate resin | |
|---|---|
| Oligomer solution-A | 260 parts |
| Methylene chloride | 100 parts |
| p-t-Butylphenol | 0.3 parts |

The above components were introduced into a reactor equipped with a stirrer, and subjected to stirring at 550 rpm. Further, an aqueous solution of the following composition was charged thereinto to carry out an interfacial polymerization for 3 hours:

| | |
|---|---|
| Sodium hydroxide | 14 parts |
| Triethylamine | 0.07 parts |
| Water | 80 parts |

The reaction mixture was separated to collect a solution of the resulting polycarbonate resin in methylene chloride, which was then washed with water, a hydrochloric acid solution and water in this order. Finally, methylene chloride was evaporated to isolate the resin. This resin (Resin No. F) had a viscosity-average molecular weight of 44,200.

EXAMPLE 1

To compare the modified polycarbonates shown in Table 1 with a commercially available polycarbonate (IUPILON S-1000, manufactured by Mitsubishi Gas Chemical Co., Inc.) with respect to solution stability, their 10- % solutions in tetrahydrofuran were prepared and left to stand at room temperature for one month to measure their solution viscosities.

As a result, the solution of the commercially available polycarbonate became completely cloudy after 10 days, which means that gelation took place. On the other hand, none of the modified polycarbonates (A–E) of the present invention became cloudy even after one month, meaning that no gelation took place, and no change was observed in their solution viscosities.

TABLE 1

| Resin No. | Phenolic Compound for Modified Polycarbonate | Weight Ratio | Viscosity-Average Molecular Weight (Mv) |
|---|---|---|---|
| A | 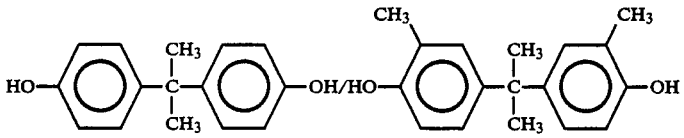 | 6/4 | 42,800 |
| B | Same | 6/4 | 24,800 |
| C | Same | 7/3 | 15,500 |
| D | 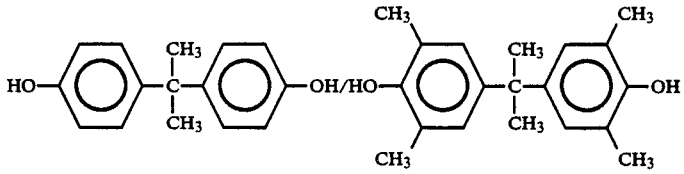 | 5/5 | 27,700 |

TABLE 1-continued

| Resin No. | Phenolic Compound for Modified Polycarbonate | Weight Ratio | Viscosity-Average Molecular Weight (Mv) |
|---|---|---|---|
| E | 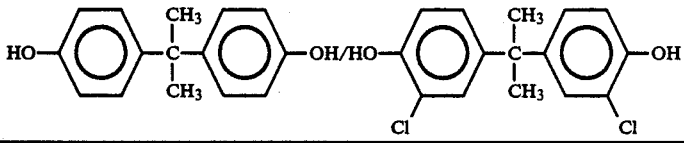 | 2/8 | 18,600 |

EXAMPLE 2

The comparison of the modified polycarbonates shown in Table 2 with the commercially available polycarbonate (IUPILON S-1000, manufactured by Mitsubishi Gas Chemical Co., Inc.) was carried out with respect to solution stability. Their 10- % solutions in tetrahydrofuran were prepared and left to stand at room temperature for one month to measure their solution viscosities. As a result, the solution of the commercially available polycarbonate became completely cloudy after 10 days, which means that gelation took place. On the other hand, none of the modified polycarbonates (F–H) of the present invention became cloudy even after one month, meaning that no gelation took place, and no change was observed in their solution viscosities.

TABLE 2

| Resin No. | Phenolic Compound for Modified Polycarbonate | Viscosity-Average Molecular Weight (Mv) |
|---|---|---|
| F | 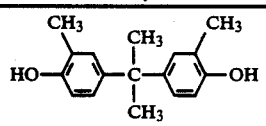 | 44,200 |
| G | 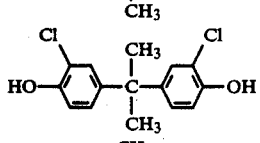 | 14,800 |
| H | 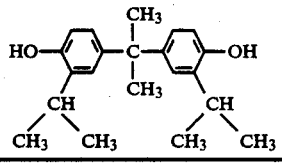 | 17,200 |

EXAMPLE 3

10 parts of a bisazo compound having the structure shown below, 5 parts of a phenoxy resin (PKHH, manufactured by Union Carbide) and 5 parts of a polyvinyl butyral resin (BH-3, manufactured by Sekisui Chemical Co., Ltd.) were mixed with 100 parts of 4-methoxy-4-methylpentanone-2, and subjected to a pulverization and dispersion treatment by a sand grind mill. The resulting dispersion was applied in a dry thickness of 0.4 g/m$^2$ by a film applicator to an aluminum vapor deposition layer formed on a 100-μm-thick polyester film, and dried.

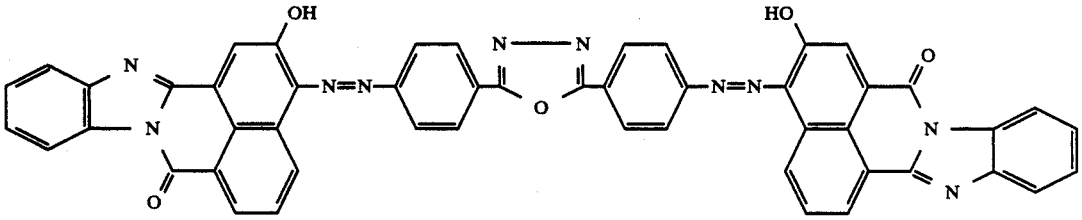

The charge carrier-generating layer thus obtained was coated with a solution of 90 parts of N-methylcarbazole-3-aldehydediphenylhydrazone, 100 parts of the modified polycarbonate resin A shown in Table 1 and 4.5 parts of a cyano compound having the following structure:

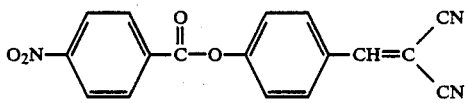

in 900 parts of 1,4-dioxane, in a dry thickness of 17 μm to form a charge carrier transfer layer. Thus, the double layer-type photosensitive member 2-A was prepared.

The photosensitive member thus prepared was measured with respect to their properties. First, the photosensitive member moving at a constant velocity of 150 mm/sec was subjected to corona discharge in the dark so that corona current of 22 μA flowed in the photosensitive member, and the potential of the charged photosensitive member was measured to determine an initial charge voltage (initial potential) $V_0$, and its residual potential ($V_r$) was also measured. It was then exposed to a white light of 5 lux to determine the amount of light exposure ($E_{\frac{1}{2}}$) necessary for reducing the surface potential of the photosensitive member by half from the initial charge voltage, namely a half-decay exposure. The results are shown in Table 4.

EXAMPLES 4–7

Example 3 was repeated except for using the modified polycarbonate resins B, C, D and E shown in Table 1 in place of the modified polycarbonate resin used in Example 3 to prepare photosensitive members in 3-B, 4-C, 5-D and 6-E. Their properties were measured as in Example 3. The results are shown in Table 4.

COMPARATIVE EXAMPLES 1–3

Example 3 was repeated except for using a commercially available polycarbonate (IUPILON S-1000, manufactured by Mitsubishi Gas Chemical Co., Inc.) and modified polycarbonates J and K shown in Table 3 in place of the modified polycarbonate in Example 3 to prepare photosensitive members 1-I, 2-J and 3-K.

The properties of the resulting photosensitive members were measured as in Example 3. The results are shown in Table 4.

TABLE 3

| Resin No. | Phenolic Compound for Modified Polycarbonate | Viscosity-Average Molecular Weight (Mv) |
|---|---|---|
| J | 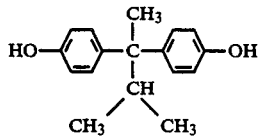 | 29,700 |
| K | 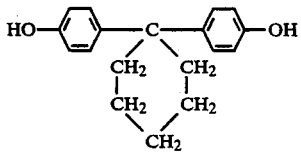 | 18,000 |

TABLE 4

| Sample No. | Photosensitive Member | Initial Potential ($V_O$) | Residual Potential ($V_r$) | Half-Decay Exposure (lux · sec) |
|---|---|---|---|---|
| Example 3 | 2-A | −689 | −7 | 1.19 |
| Example 4 | 3-B | −678 | −6 | 1.26 |
| Example 5 | 4-C | −660 | −6 | 1.24 |
| Example 6 | 5-D | −682 | −3 | 1.20 |
| Example 7 | 6-E | −675 | −4 | 1.21 |
| Comparative Example 1 | 1-I | −654 | −4 | 1.37 |
| Comparative Example 2 | 2-J | −630 | −8 | 1.38 |
| Comparative Example 3 | 3-K | −670 | −6 | 1.36 |

As is clear from Table 4, the photosensitive members of the present invention are superior to the photosensitive members containing the commercially available polycarbonates in terms of electric properties.

EXAMPLES 8–10

Example 3 was repeated except for using the modified polycarbonate resins F, G and H shown in Table 2 in place of the modified polycarbonate resin used in Example 3 to prepare photosensitive members 7-F, 8-G and 9-H. Their properties were measured as in Example 3. The results are shown in Table 5.

TABLE 5

| Example No. | Photosensitive Member | Initial Potential ($V_O$) | Residual Potential ($V_r$) | Half-Decay Exposure (lux · sec) |
|---|---|---|---|---|
| 8 | 7-F | −660 | −5 | 1.20 |
| 9 | 8-G | −635 | −3 | 1.15 |
| 10 | 9-H | −640 | −7 | 1.28 |

As is clear from Table 5, the photosensitive members of the present invention are superior to the photosensitive members containing the commercially available polycarbonates in terms of electric properties.

EXAMPLE 11

A mirror-finished aluminum cylinder was dipped in the pigment dispersion in Example 3 so that a charge carrier-generating layer of 0.4 μm in dry thickness was prepared. This was then dipped in a solution of the charge carrier transfer material and the modified polycarbonate resin A in 1,4-dioxane used in Example 3, so that it was coated with a charge carrier transfer layer of 20 μm in dry thickness.

The drum-shaped photosensitive member thus prepared is called 10-A. To evaluate the durability of this photosensitive member, this photosensitive member was installed in a commercially available copier utilizing a blade cleaning system, and subjected to a copy test. As a result, even after producing 40,000 copies, no deep damage was appreciated on the surface of the photosensitive member, and the copy images suffered from substantially no black streaks which were considered to be caused by the damage of the photosensitive member. Thus, good copy images were obtained. The wear of the photosensitive member was 1.1 μm. Further, it had extremely stable potential properties as shown in Table 6, which means that it has sufficient durability.

TABLE 6

| Photosensitive Member 10-A | Voltage in Dark Area ($V_D$) | Voltage in Light Area ($V_L$) |
|---|---|---|
| At start | −650 V | −115 V |
| After Producing 40,000 Copies | −590 V | −95 V |

EXAMPLE 12

A mirror-finished aluminum cylinder was dipped in the pigment dispersion in Example 3 so that a charge carrier-generating layer of 0.4 μm in dry thickness was prepared. This was then dipped in a solution of the charge carrier transfer material and the the modified polycarbonate resin F in 1,4-dioxane used in Example 8, so that it was coated with a charge carrier transfer layer of 20 μm in dry thickness.

The drum-shaped photosensitive member thus prepared is called 11-F. To evaluate the durability of this photosensitive member, this photosensitive member was installed in a commercially available copier utilizing a blade cleaning system, and subjected to a copy test. As a result, even after producing 40,000 copies, substantially no wear by the cleaning blade and no deep damage were appreciated on the surface of the photosensitive member, and the copy images suffered from substantially no black streaks which were considered to be caused by the damage of the photosensitive member. Thus, good copy images were obtained. The wear of the photosensitive member was 0.7 μm. Therefore, it may be concluded that it has excellent mechanical properties. It also had extremely stable potential properties as shown in Table 7, which means that it has sufficient durability.

TABLE 7

| Photosensitive Member 11-F | Voltage in Dark Area ($V_D$) | Voltage in Light Area ($V_L$) |
|---|---|---|
| At start | −700 V | −120 V |
| After Producing 40,000 Copies | −670 V | −100 V |

COMPARATIVE EXAMPLE 4

A drum sample 4-I was prepared in the same manner as in Example 12 except for using the resin in Comparative Example 1 (Sample 1-I) in place of the polycarbonate resin, and the same durability test as in Example 12 was conducted. As a result, after producing 40,000 copies, slight decrease in copy density was observed though no black steaks were generated by the damage of the photosensitive member. As a result of the measurement of thickness, it was found that the photosensitive member was worn by as much as 1.6 μm. Incidentally, the electric properties of the photosensitive member changed as shown in Table 8.

TABLE 8

| Photosensitive Member 4-I | Voltage in Dark Area ($V_D$) | Voltage in Light Area ($V_L$) |
|---|---|---|
| At start | −660 V | −120 V |
| After Producing 40,000 Copies | −560 V | −100 V |

COMPARATIVE EXAMPLE 5

A drum sample 5-J was prepared in the same manner as in Example 12 except for using the resin in Comparative Example 2(Sample 2-J) in place of the polycarbonate resin. After producing 40,000 copies, no damage was observed on the photosensitive member, but it was worn as much as 1.3 μm, and it suffered from large change of potential as shown in Table 9.

TABLE 9

| Photosensitive Member 5-J | Voltage in Dark Area ($V_D$) | Voltage in Light Area ($V_L$) |
|---|---|---|
| At start | −640 V | −110 V |
| After Producing 40,000 Copies | −560 V | −120 V |

EXAMPLE 13

5parts of bisazo compound having the structure shown below was added to 180 parts of cyclohexanone, and preliminary dispersed by a sand grind mill.

In the meantime, 50 parts of a polycarbonate resin having a bisphenol component shown as F in Table 2, and 50 parts of a hydrazone compound having the structure shown below were dissolved in 380 parts of cyclohexanone, and the above preliminary dispersion was added. A full dispersion treatment was conducted by a sand grind mill.

bisazo pigment

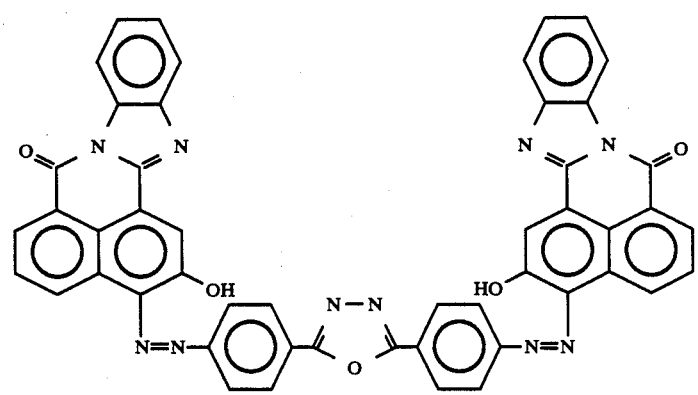

hydrazone compound

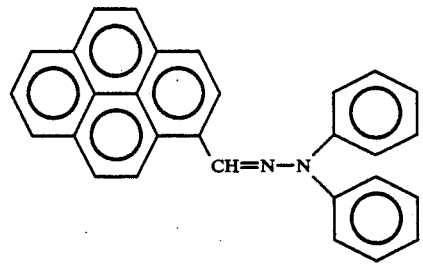

This coating dispersion was applied to a mirror-finished aluminum cylinder of 1 mm in thickness by spraying, and then dried to provide a photosensitive member having a photosensitive layer of 20 μm in thickness.

The resulting photosensitive layer had good luster and was uniform free from defects. In addition, after one month, the above dispersion remained stable without causing any agglomeration.

As a result of the measurement of this photosensitive member with respect to the electric properties, it was found that it had an initial potential ($V_0$) of +700 V, a half-decay exposure ($E_{\frac{1}{2}}$) of 1.1 lux.sec, and a residual potential ($V_r$) of +30 V. This shows that the photosensitive member had high sensitivity.

EXAMPLE 14

A dispersion for coating was prepared in the same manner as in Example 13 except for using a resin containing a bisphenol component shown as H in Table 2 instead of the polycarbonate resin, to produce a photosensitive member. As a result of the measurement of electrophotographic characteristics, it was found that it has an initial potential of +710 V, a half-decay exposure of 1.2 lux.sec and a residual potential of +32 V. The dispersion for coating remained stable even after it was left to stand for 1 month.

COMPARATIVE EXAMPLE 6

A dispersion for coating was prepared in the same manner as in Example 1 except for using a polycarbonate resin having the following repeating unit as a binder resin.

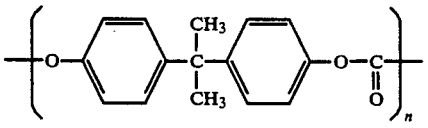

However, the dispersion for coating was poor in stability, suffering from drastic increase in viscosity by leaving it to stand, and after one month, it became completely gel. It was never returned to the original liquid even by a redispersion treatment such as an ultrasonic treatment, etc.

EXAMPLE 15

A photosensitive member sample was prepared in the same manner as in Example 13 except for using oxytitanium phthalocyanine as a charge carrier-generating material and a hydrazone compound having the structure shown below as a charge carrier transfer material. A dispersion for coating in this Example was gradually agglomerated, but by an ultrasonic treatment before coating, it was completely returned to a dispersion which could easily be applied to provide a uniform photosensitive layer free from defects.

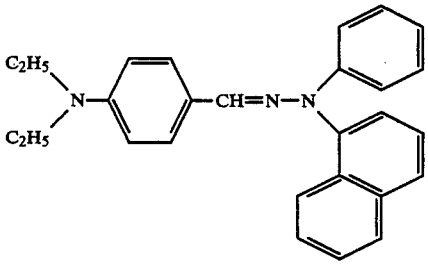

As a result of the measurement of electrophotographic properties of this photosensitive member, it was found that it had excellent properties as follows: an initial potential of +700 V, a sensitivity to semiconductor laser of 780 nm (half-decay exposure) of 0.5 $\mu J/cm^2$, and a residual potential of +30 V.

EXAMPLE 15

The photosensitive member prepared in Example 13 was assembled in a copying machine of the positive charge process blade cleaning-type using a commercially available selenium drum to evaluate the durability of the photosensitive member. Incidentally, to obtain stable potential, a scorotron with a grid was used as a charger. As a result, even after a running test of 100,000 copies, clear copies completely free from image noises due to the damage of the photosensitive member, toner filming, etc. and fogging were obtained. With respect to electric properties, it showed in the beginning an initial potential of +800 V, and a background potential of 120 V, while its initial potential was +820 V and background potential of 125 V after producing 100,000 copies. The wear of the photosensitive member was 2 $\mu$m. The photosensitive member of the present invention was extremely wear-resistant photosensitive member capable of producing 100,000 or more copies.

As is clear from the above results; the modified polycarbonate of the present invention has excellent properties as a binder resin for photosensitive members for electrophotography.

Specifically, the modified polycarbonate resin according to the present invention has excellent solubility and solution stability, so that the photosensitive member with extremely few coating defects can be provided by applying a solution thereof. Thus, the productivity of the photosensitive member is greatly increased.

And even if the photosensitive member containing the modified polycarbonate resin of the present invention is used repeatedly, it hardly suffers from the deterioration of sensitivity and chargeability. Also, its wear is extremely small. Therefore, it can enjoy extremely good durability.

Further, the photosensitive member of the present invention may be used for wide varieties of applications not only in electrophotographic copiers but also in printers using as light sources laser, LED, LCD, CRT, etc.

What is claimed is:

1. A photosensitive member for electrophotography comprising a photosensitive layer on a conductive substrate, said photosensitive layer containing as a binder resin a modified polycarbonate resin having the repeating structural unit represented by the following general formula (1):

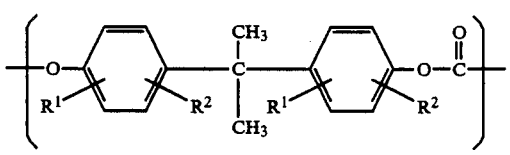

(1)

wherein $R^1$ and $R^2$ are selected from a hydrogen atom, an alkyl group having 1–3 carbon atoms and a halogen atom, at least one of $R^1$ and $R^2$ being the alkyl group or the halogen atom.

2. The photosensitive member for electrophotography according to claim 1, wherein said modified polycarbonate resin has the repeating structural units represented by the following general formula (1) and (2):

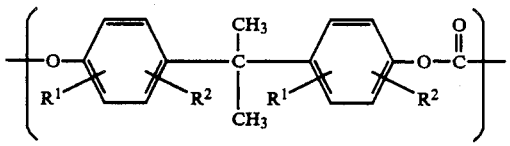

(1)

wherein $R^1$ and $R^2$ are selected from a hydrogen atom, an alkyl group having 1–3 carbon atoms and a halogen atom, at least one of $R^1$ and $R^2$ being the alkyl or the halogen atom, and

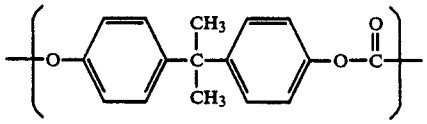

(2)

the ratio of the repeating structural unit of the general formula (1) to that of the general formula (2) being at least 20:80.

3. The photosensitive member for electrophotography according to claim 1, wherein said modified polycarbonate resin has a viscosity-average molecular weight of 10,000–50,000.

4. The photosensitive member for electrophotography according to claim 3, wherein said modified polycarbonate resin has a viscosity-average molecular weight of 10,000–50,000.

5. The photosensitive member for electrophotography according to claim 1, wherein said photosensitive member is constituted by a charge carrier-generating layer and a charge carrier transfer layer constructed thereon, and said modified polycarbonate resin is contained as a binder resin in said charge carrier transfer layer.

6. The photosensitive member for electrophotography according to claim 2, wherein said photosensitive member is constituted by a charge carrier-generating layer and a charge carrier transfer layer constructed thereon, and said modified polycarbonate resin is contained as a binder resin in said charge carrier transfer layer.

7. The photosensitive member for electrophotography according to claim 1, wherein said photosensitive layer has a matrix phase containing a charge carrier transfer material and a binder resin, in which a charge carrier-generating material particles are dispersed.

8. The photosensitive member for electrophotography according to claim 2, wherein said photosensitive layer has a matrix phase containing a charge carrier transfer material and a binder resin, in which a charge carrier-generating material particles are dispersed.

* * * * *